US006102203A

United States Patent [19]

Marro

[11] Patent Number: 6,102,203

[45] Date of Patent: Aug. 15, 2000

[54] TOOTHBRUSH COVER AND HOLDING ASSEMBLY

[76] Inventor: Brian Marro, 7108 Fairway Dr., Suite #260, Palm Beach Gardens, Fla. 33418

[21] Appl. No.: 09/309,814

[22] Filed: May 11, 1999

[51] Int. Cl.[7] ..... A45D 44/18

[52] U.S. Cl. ..... 206/362.1; 206/457; 211/65

[58] Field of Search ..... D6/528; D26/9, D26/10, 13, 14, 16, 22; 206/362.1, 446, 457, 779; 211/65; 248/110, 111

[56] References Cited

U.S. PATENT DOCUMENTS

| | | | |
|---|---|---|---|
| D. 68,947 | 12/1925 | Bergstrom | D26/14 |
| D. 104,372 | 5/1937 | Farber | D26/13 |
| D. 125,571 | 3/1941 | Kessler | D26/14 |
| D. 154,901 | 8/1949 | Bussey | D26/10 |
| D. 161,196 | 12/1950 | Moskowitz . | |
| D. 178,721 | 9/1956 | Davis | D26/22 |
| D. 347,033 | 5/1994 | Moretz | D21/109 |
| 4,756,405 | 7/1988 | Crozier | 211/65 |
| 5,269,420 | 12/1993 | Harrison et al. | 206/362.3 |
| 5,348,145 | 9/1994 | Steinfels, III | 206/446 |
| 5,638,840 | 6/1997 | Lee et al. | 132/310 |
| 5,769,245 | 6/1998 | Butler | 211/65 |
| 5,779,046 | 7/1998 | Plakos | 206/362.3 |

*Primary Examiner*—Jim Foster
*Attorney, Agent, or Firm*—David P. Lhota, Esq.; Bowen & Lhota, P.A.

[57] ABSTRACT

A toothbrush cover and holding assembly that resembles a football helmet and goal posts, or other sport equipment and/or playing surface, to protect and support a toothbrush when it is not in use while at the same time encouraging children to brush their teeth by creating an association with a recognized team, wherein the assembly includes a plurality of uprights substantially vertically oriented and having passages for receiving and supporting toothbrushes, a base structure that facilitates engagement to a horizontal or vertical surface while maintaining the uprights in a vertical position, and at least one toothbrush cover having a cavity for receiving the brush end of a toothbrush.

17 Claims, 4 Drawing Sheets

TOOTHBRUSH COVER AND HOLDING ASSEMBLY

CROSS REFERENCE TO RELATED APPLICATIONS

None.

STATEMENT REGARDING FEDERALLY SPONSORED RESEARCH OR DEVELOPMENT

None.

COPYRIGHT NOTICE

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The instant invention relates generally to a toothbrush cover and holding assembly, and more particularly, to a toothbrush cover and holding assembly that resembles a football helmet and goal posts to protect and support a toothbrush when it is not in use while at the same time encouraging children to brush their teeth by providing an assembly that corresponds to their favorite football team. The instant invention may also be adapted to other sports as described herein.

2. Description of the Background Art

One of the more difficult challenges a parent faces is getting their children to brush their teeth regularly. A variety of teeth cleaning devices with enticing designs have been provided in an attempt to enhance children's interest in brushing. These devices, however, neglect the importance of making toothbrushes ergonomically practical and easy to handle and store. When a toothbrush design is bulky it becomes more difficult to properly use, thus frustrating its intended purpose, and cannot be properly stored in a holder to keep the toothbrush off soiled sinks and counter tops. As professional sports and teams capture the imagination of children, a toothbrush cover and holder that reflects a sports theme without compromising the structural integrity of toothbrushes would be well received. There are currently no known devices which achieve this objective as contemplated by the instant invention.

Although there are several designs known in the background art for enticing children to brush, they fail to adequately address the above noted problems. For instance, U.S. Pat. No. 5,769,245, issued to Butler, discloses a toothbrush holder generally comprising a base with a central member, a distal handle end support member and a dome. U.S. Pat. No. 5,638,840, issued to Lee et al., discloses a combination toothpaste dispenser, toothbrush holder, drinking cup and floss dispenser forming a unitary structure simulative of a cat. U.S. Pat. No. 5,269,420, issued to Harrison et al., discloses a toothbrush and holder assembly wherein the toothbrush comprises a utensil having a brush at one end and a ball shape at the other end and the holder comprises the shape of a human sporting figure with arms that extend outwardly and are sized and arranged to cradle the utensil at the ball shaped end. U.S. Pat. No. Des. 161,196, issued to Moskowitz, comprises a toothbrush and toothpaste tube holder in shape of two humanlike teeth. U.S. Pat. No. Des. 347,033, issued to Moretz, discloses a goal post toy. U.S. Pat. No. 5,779,046, issued to Plakos, discloses a decorative mask-like toothbrush guard which covers nearly the entire head of a toothbrush thereby preventing germs or dust from coming into contact with the head. While the foregoing disclose various toothbrush and holder assemblies, they fail to teach or suggest a toothbrush helmet and holder assembly in the shape of professional athletic devices, such as a helmet and goal post or goal, that provides sanitary protection while enticing children to brush. The invention may also prove beneficial to sports enthusiast, regardless of age.

BRIEF SUMMARY OF THE INVENTION

Based on the foregoing, it is an object of the instant invention to provide a toothbrush helmet and holder assembly that encourages children and/or sports enthusiast to practice proper dental hygiene.

It is another object of the instant invention to provide a toothbrush helmet and holder assembly that supports a plurality of toothbrushes and protects toothbrushes from germs, dust and other air borne particles.

It is an additional object of the instant invention to provide a toothbrush helmet and holder assembly that includes indicia of predetermined sports teams.

It is a further object of the instant invention to provide a toothbrush helmet and holder assembly that resembles a football helmet and goal posts, respectively.

It is also an object of the instant invention to provide a toothbrush helmet and holder assembly that resembles a hockey helmet and goal, respectively.

It is still another object of the instant invention to provide a toothbrush helmet and holder assembly that resembles a baseball cap and baseball equipment, respectively.

It is still another object of the instant invention to provide a toothbrush helmet and holder assembly that includes at least one toothbrush having a shape and/or indicia consistent with the theme of the helmet and holder assembly.

In light of these and other objects, the instant invention comprises a toothbrush helmet and holding assembly that covers, protects and holds toothbrushes while enticing proper dental hygiene (brushing) with a sports theme. The preferred embodiment of the toothbrush helmet and holding assembly comprises a removable cover in the shape of a football helmet and a holding assembly in the shape of goal posts. The cover defines a cavity at the underside of the helmet that has dimensions for receiving, or snugly receiving, the brush end of a standard toothbrush. Covers may be provided for receiving toothbrushes of varying sizes. The cover is preferably in the shape of a football helmet, or includes a removable or non-removable shell in the shape of a football helmet. In an alternative embodiment, the cover and/or shell comprises a baseball cap, hockey mask or other sport helmet.

The holding assembly preferably comprises a structure resembling a football goal post. The holding assembly includes a base for supporting and balancing the assembly on a counter top. Alternatively, the holding assembly may be structured for mounting to a vertical surface, such as a wall, while maintaining the goal post in a substantially vertical orientation. The holding assembly also comprises two hollow upright members each defining an elongated cavity sized for receiving the handle portion of a toothbrush. The upright members are joined by a cross member. The cross member and base are joined by an extension member. The extension member may be designed, dimensioned and shaped to accommodate either horizontal or vertical mounting. In an alternative embodiment, the holding assembly may be in the shape of hockey goal, baseball diamond, baseball bats, tennis court or other sports related equipment or playing surfaces.

DETAILED DESCRIPTION OF THE INVENTION

Figure 1:
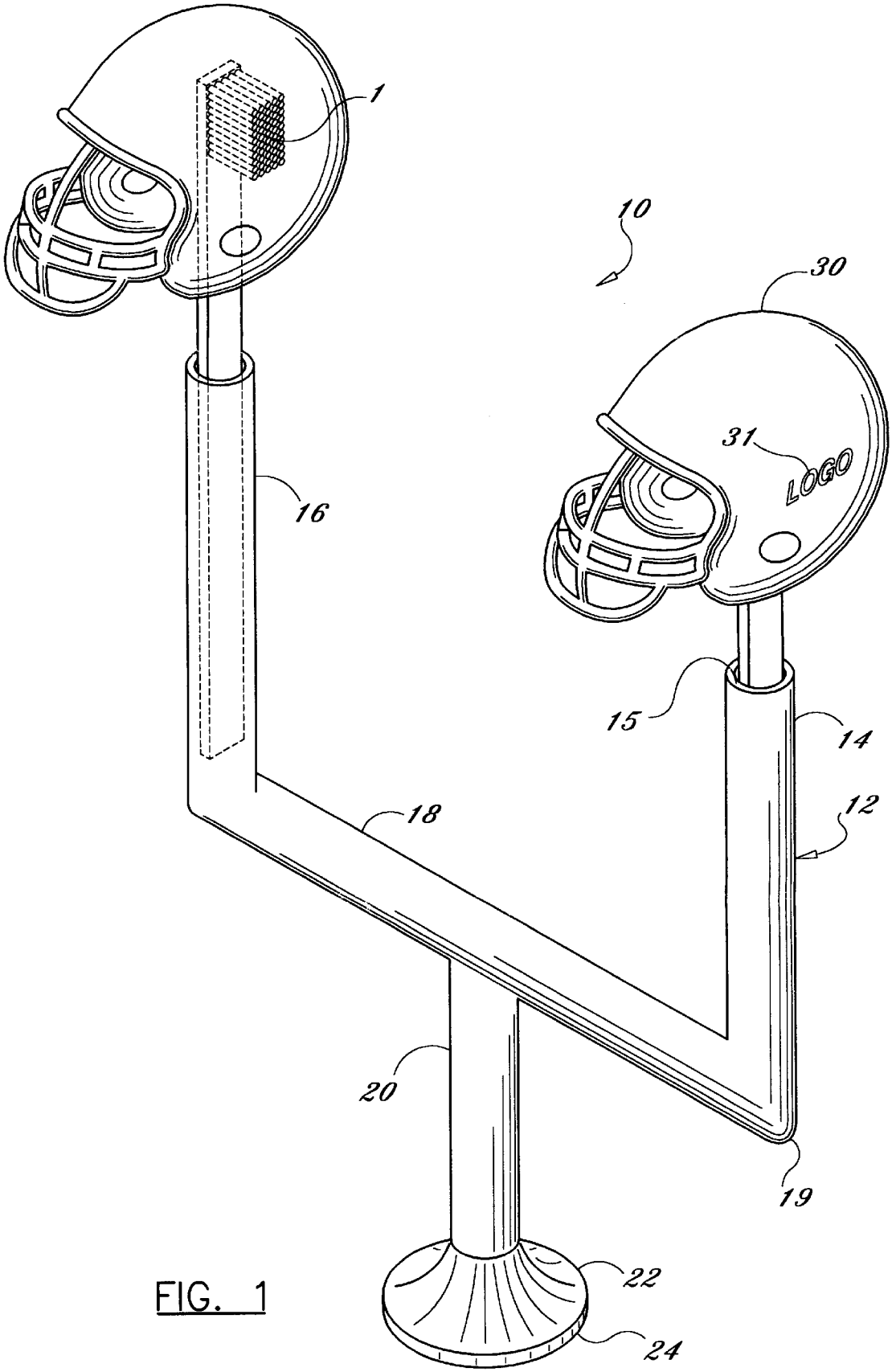
FIG. 1 is a perspective view of the preferred embodiment of the toothbrush helmet and holding assembly of the instant invention, illustrating one of the toothbrushes in phantom.
Figure 2:
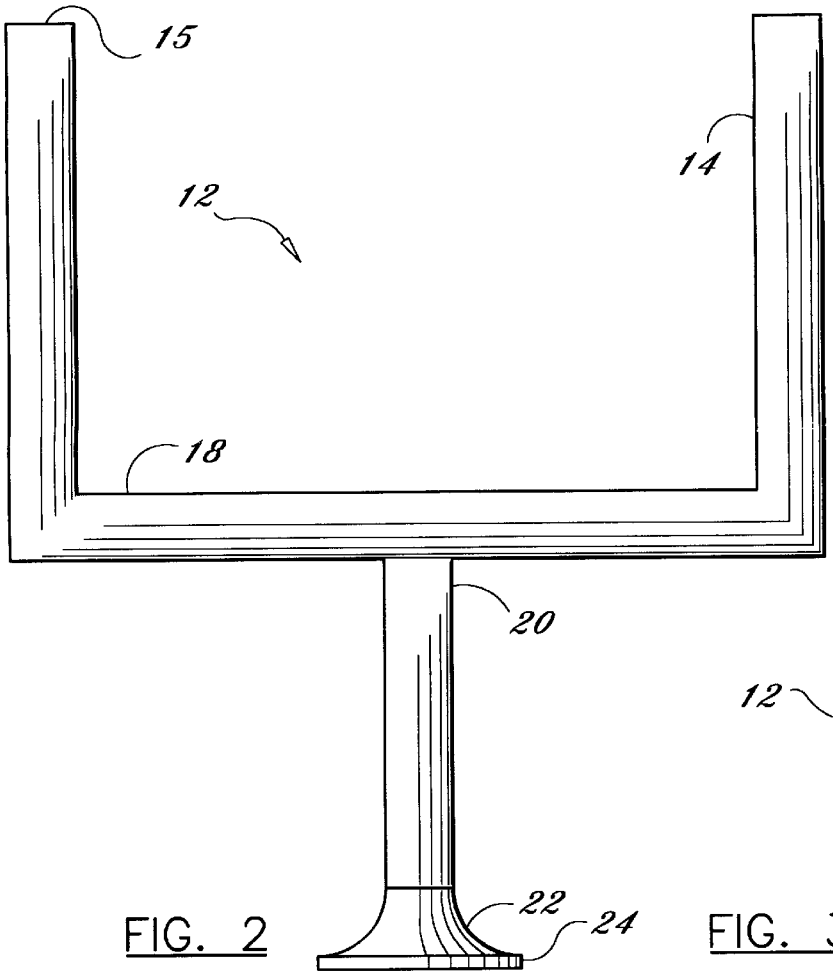
FIG. 2 is a front elevational view of the toothbrush holding assembly of the instant invention.
Figure 3:
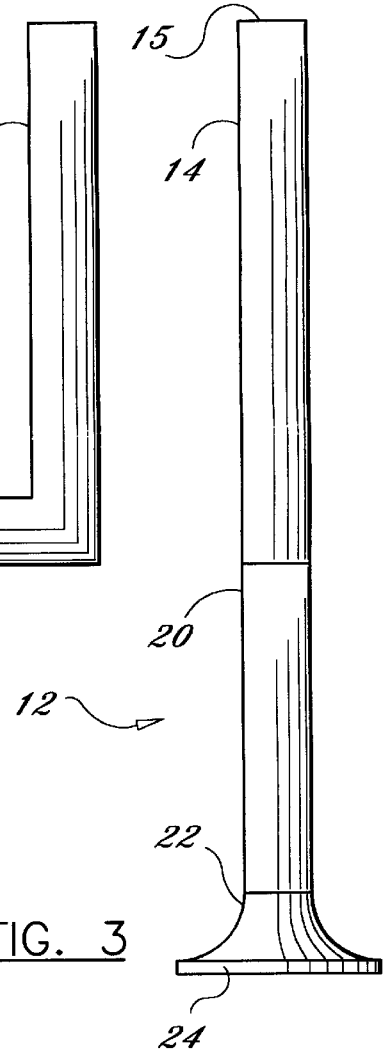
FIG. 3 is a side elevational view of the toothbrush holding assembly of the instant invention.
Figure 4:
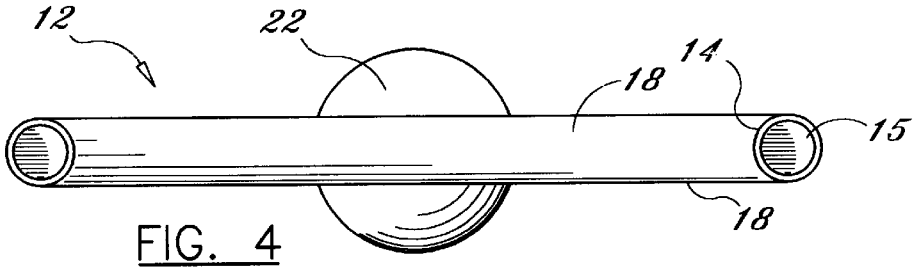
FIG. 4 is a top planar view of the toothbrush holding assembly of the instant invention.
Figure 5:
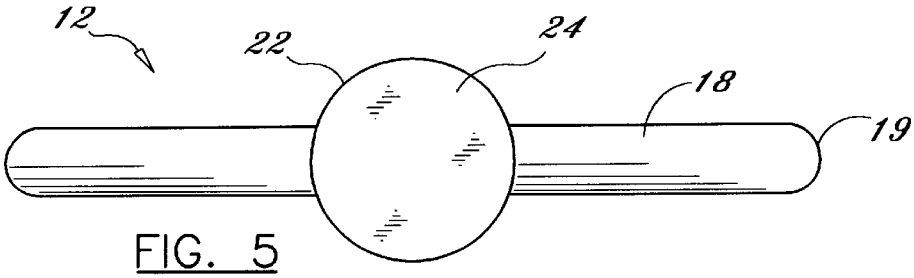
FIG. 5 is a bottom planar view of the toothbrush holding assembly of the instant invention.
Figure 6:
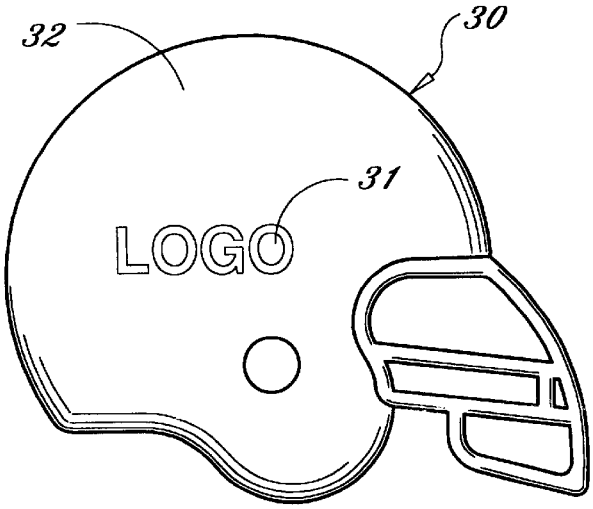
FIG. 6 is a side elevational view of the toothbrush cover of the instant invention.
Figure 7:
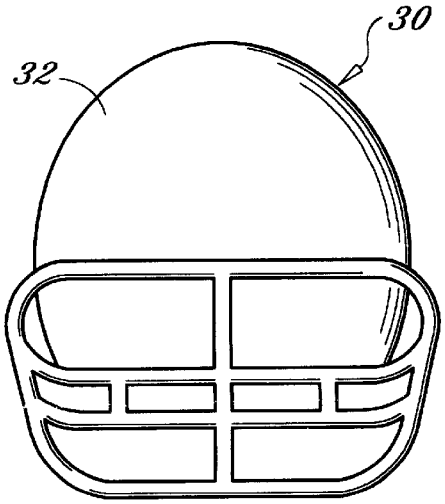
FIG. 7 is a front elevational view of the toothbrush cover of the instant invention.
Figure 8:
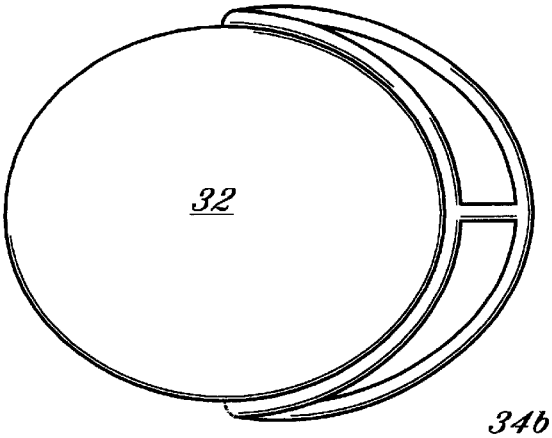
FIG. 8 is a top planar view of the toothbrush cover of the instant invention.
Figure 9:
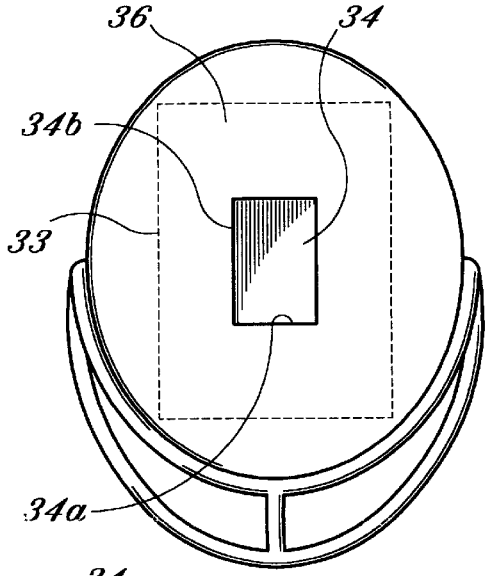
FIG. 9 is a bottom planar view of the toothbrush cover of the instant invention, illustrating the toothbrush receiving cavity of the instant invention.
Figure 10:
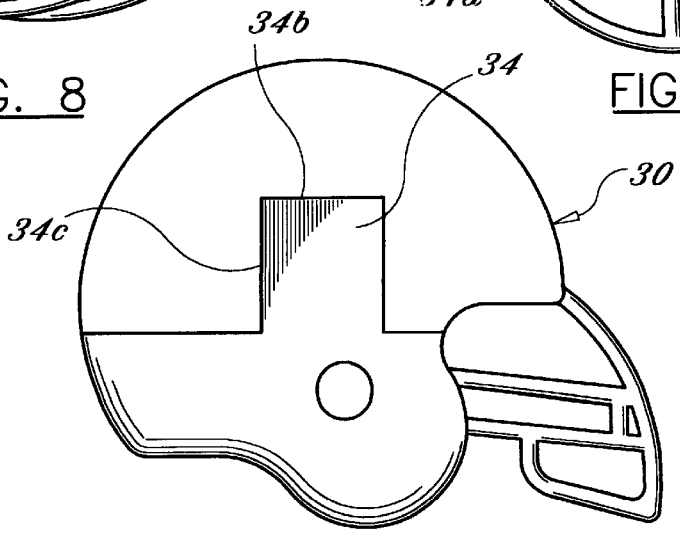
FIG. 10 is a side elevational view of the toothbrush cover of the instant invention, illustrating the toothbrush receiving cavity of the instant invention.
Figure 12:
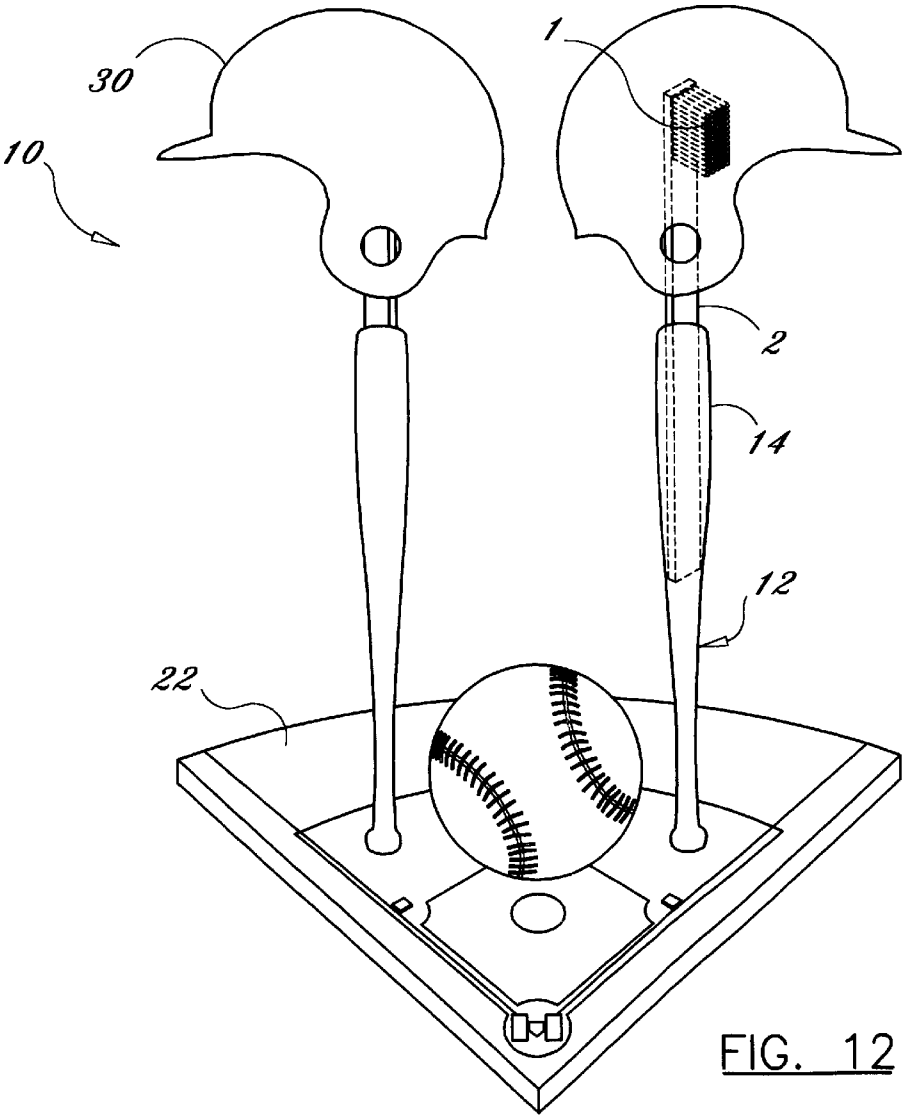
FIG. 12 is a perspective view of an alternative embodiment of the toothbrush helmet and holding assembly of the instant invention, illustrating a baseball theme.
Figure 11:
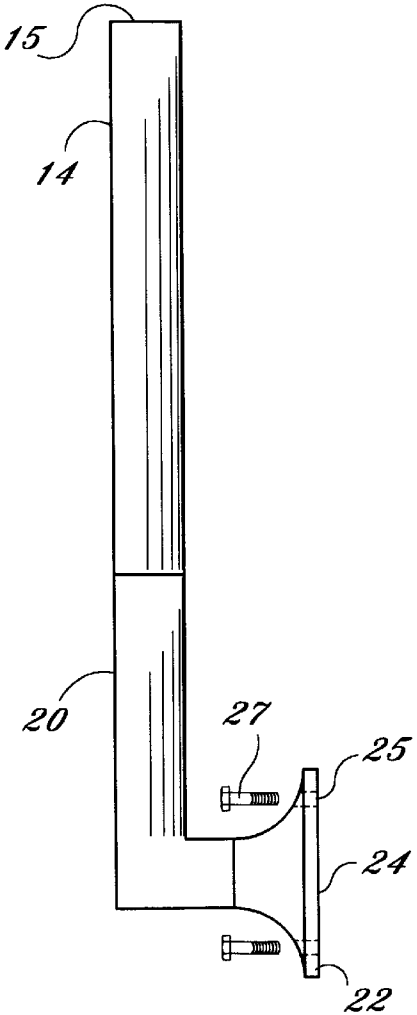
FIG. 11 is a side elevational view of the toothbrush holding assembly of the instant invention illustrating attachment to a vertical surface.

With reference to the drawings, FIGS. 1–10 depict the preferred embodiment of the instant invention, and FIGS. 11–12 depict alternative embodiments of the instant invention, which is generally characterized by the numeric character 10. Referring to FIG. 1, the instant invention 10 comprises a toothbrush holding assembly 12 and at least one toothbrush cover 30. The instant invention may also include at least one toothbrush 1 in a complete system embodiment. The holding assembly 12 is preferably in the shape of a football goal post. The holding assembly 12 comprises two hollow uprights 14 separated and/or joined by a cross member 18, a base 22 and an extension member 20 separating and joining the base 22 and cross member 18. The cross member 18 preferably blends into the lower ends of said uprights 14 at juncture 19. The cross member 18 and extension member 20 may also be hollow to limit the material cost in manufacturing. The uprights 14, extension member 20 and/or cross member 18 are preferably cylindrical to simulate the shape of conventional goal post, but may comprise other geometric shapes. The hollow uprights 18 each define an elongated cavity 15 dimensioned for receiving the handle 2 of a toothbrush 1. The cavities 15 are preferably circular or rectangular in cross section, but may comprise any other geometric shape without departing from the scope and spirit of the invention. The cavities 15 may also define a predetermined depth so as to keep the cover 30 and brush portion of the toothbrush 1 above the top end of the uprights 14. Accordingly, this depth should be shorter than the length of the toothbrush handle, but may vary.

The base 22 and extension member 20 are preferably designed for supporting and balancing the assembly on a counter top or wall, while maintaining the uprights in a substantially vertical orientation. The base 22 may comprise a metal platform attached to or joined to the lower end of the extension member with hardware and/or by interlocking engagement. The base 22 and extension member 20 may also comprise an integral piece. The holding assembly 14 shown in FIGS. 1–5 depicts a holding assembly 14 designed for resting on a substantially horizontal surface. In this configuration, the base 22 may comprise a rigid piece having sufficient weight and durability for supporting the holding assembly 12. The base 22 may also include or comprise a suctioning device, such as a suction cup, for attaching to a flat surface, such as a counter top or wall. The suction cup may be made from rubber, a rubber-like material or plastic-like material. The suction cup may also comprise either the base 22 or an insertion or attachment at the base bottom 24. In the embodiment designed for attachment to a substantially vertical surface, the extension member 20 and/or base 22 includes at least one bend that facilitates the attachment of the base 22 to a vertical surface while vertically orienting the uprights 14, as seen in FIG. 11. In this embodiment, the base 22 may include apertures 25 and hardware 27 for effecting attachment to a wall or similar surface. Other attachment devices known in the art may be employed.

The cover 30 removably attaches to a toothbrush 1 for protecting the bristles from dust, dirt and other ambient elements. With reference to FIGS. 1 and 6–10, the cover 30 preferably comprises a simulation of a football helmet, but may also simulate other athletic headwear. The cover 30 comprises a shell 32, indicia 31 visible on the shell 32 and a cavity 34. The cavity 34 is accessed at the underside of the cover 30 and has dimensions 34 *a–c* for snugly receiving the brush end of a standard toothbrush 1. The dimensions and shape of the cavity 34 may vary for receiving toothbrushes of varying sizes. For a toothbrush 1 having a substantially rectangular head, the cavity 34 has a width 34*a*, a length 34*b* and a depth 34*c*. The cavity 34 may also include pliable flaps at the entrance of the cavity 34 to resist inadvertent removal of the cover 30 from the toothbrush. The shell 32 may comprise the cover 30, a permanent component of the cover 30, or a removable part of the cover 30. The cover 30 may also include a base frame or chassis 33 to which the shell 32 is removably or permanently attached. In such an embodiment, the chassis 33 defines the cavity 34. In the embodiment comprising a removable shell 32, the shell 32 may be interchanged with helmets or headgear of other teams or sports. The cover 30 further comprises indicia 31, typically in the form of team logos. The indicia 31 may be imprinted or adhered to the shell 31 or by any other known techniques.

The instant invention is designed to simulate football goal posts and helmets for enticing and encouraging children to brush their teeth. It is recognized that other sport themes may also encourage brushing. Accordingly, in an alternative embodiment, the toothbrush cover 30 and holding assembly 12 may simulate items from other sports. For instance, the cover 30 may comprise a baseball helmet and the holding assembly 12 may comprise a base 22 in the shape of a baseball field and uprights 14 in the shape of substantially vertical, hollow bats for receiving and supporting toothbrushes, as shown in FIG. 12. The holding assembly 12 may also be in the shape of a hockey goal, baseball diamond, basketball court, tennis court, racing cars or other sports related equipment or playing surfaces. Likewise, the cover 30 may also be in the shape of other sports headgear, such as a hockey mask, racecar helmet, baseball cap, etc. In another embodiment, the toothbrush 1 may be in the shape of a baseball bat, hockey stick, tennis racket or other sports equipment. The invention may also include indicia on the toothbrush consistent with the theme of the holding assembly 12 and cover 30. The invention 10 in another embodiment may include storage space for toothpaste, dental floss and/or mouthwash.

The holding assembly 12 and cover 30 are preferably manufactured from a plastic or plastic like material that may be mass-produced. The invention 10 is preferably injection molded and waterproof. The invention 10, however, may be manufactured from other materials without departing from the scope and spirit of the invention. The holding assembly 12 of the instant invention may comprise an integral piece.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A toothbrush holding and protection device for storing toothbrushes having a handle and a brush end, said device comprising:

a toothbrush holder comprising two upright and hollow cylinders, said cylinders each defining an elongated passage for receiving the handle of a toothbrush, said cylinders each having an open top end for accessing said passage and a lower end;

a cross member extending between said lower ends of said cylinders;

an extension member depending downward from said cross member and having a lower end, said uprights, cross members and extension member being substantially cylindrical; and a base at said lower end of said extension member, said base having peripheral edges extending beyond peripheral edges defined by said extension member for providing a stable platform that supports said toothbrush holder, said toothbrush holder having a recognizable shape for encouraging children to brush their teeth.

2. A device as recited in claim 1, further comprising:

at least one cover for covering the brush end of a toothbrush, said cover resembling a football helmet for encouraging children to brush their teeth.

3. A device as recited in claim 2, wherein said cover comprises:

a bottom end;

a cavity defined at said bottom end of said cover, said cavity defining a volume that facilitates receiving the brush end of a toothbrush.

4. A device as recited in claim 3, wherein said cover includes indicia identifying a predetermined football team for encouraging children to brush their teeth.

5. A device as recited in claim 3, wherein said cover comprises:

a base structure, said base structure defining said cavity; and a shell that securely mounts over said base structure and resembles a football helmet of a known football team for encouraging children to brush their teeth.

6. A device as recited in claim 2, further comprising:

at least one toothbrush having a brush end and a handle.

7. A device as recited in claim 6, wherein said passage defined by each of said uprights comprises:

an elongated passage defining a depth shorter than the length of said handle of said toothbrush so that said cover resides above said open top end a predetermined distance when mounted on the brush end of said toothbrush and when said toothbrush handle is inserted in said cavity.

8. A device as recited in claim 1, wherein said extension member and said base further comprise:

means for facilitating stable support on a substantially horizontal surface while orienting said uprights in a substantially vertical position.

9. A device as recited in claim 1, wherein said extension member and said base further comprise:

means for mounting said toothbrush holder to a substantially vertical surface while orienting said uprights in a substantially vertical position.

10. A device as recited in claim 1, wherein said recognizable shape comprises:

a football goal post.

11. A toothbrush holding and protection device for storing toothbrushes having a handle and a brush end, said device comprising:

a toothbrush holder comprising two upright and hollow cylinders, said cylinders each defining an elongated passage for receiving the handle of a toothbrush, said cylinders each having an open top end for accessing said passage and a lower end;

a cross member extending between said lower ends of said cylinders;

an extension member depending downward from said cross member and having a lower end, said extension member comprising means for orienting said uprights in a substantially vertical position;

a base at said lower end of said extension member, said base having peripheral edges extending beyond peripheral edges defined by said extension member for providing a stable platform that supports said toothbrush holder, said toothbrush holder resembling a football goal post for encouraging children to brush their teeth; and at least one cover for covering the brush end of a toothbrush, said cover resembling a football helmet and including indicia identifying a predetermined team for encouraging children to brush their teeth, said cover having a cavity defined at a bottom end of said cover for receiving the brush end of a toothbrush.

12. A device as recited in claim 11, wherein said cover comprises:

a base structure, said base structure defining said cavity; and a shell that securely mounts over said base structure and resembles a football helmet of a known football team for encouraging children to brush their teeth.

13. A device as recited in claim 11, further comprising:

at least one toothbrush having a brush end and a handle, said handle having dimensions that accommodate insertion into said upright passages and said brush end having dimensions that accommodate insertion into said cover cavity.

14. A device as recited in claim 13, wherein said passage defined by each of said uprights comprises:

an elongated passage defining a depth shorter than the length of said handle of said toothbrush so that said cover resides above said open top end a predetermined distance when mounted on the brush end of said toothbrush and when said toothbrush handle is inserted in said cavity.

15. A device as recited in claim 11, wherein said uprights, cross member and extension member are substantially cylindrical.

16. A device as recited in claim 11, wherein said extension member and said base further comprise:

means for facilitating stable support on a substantially horizontal surface while orienting said uprights in a substantially vertical position.

17. A device as recited in claim 11, wherein said extension member and said base further comprise:

means for mounting said toothbrush holder to a substantially vertical surface while orienting said uprights in a substantially vertical position.

* * * * *